United States Patent [19]

Bradlee

[11] Patent Number: 4,587,822

[45] Date of Patent: May 13, 1986

[54] TENSION LEVELING APPARATUS

[75] Inventor: Charles R. Bradlee, Sidney, Ohio

[73] Assignee: The Monarch Machine Tool Company, New Bremen, Ohio

[21] Appl. No.: 639,542

[22] Filed: Aug. 10, 1984

[51] Int. Cl.[4] ..... B21D 1/05; B21D 31/00

[52] U.S. Cl. ..... 72/163; 72/236; 72/245

[58] Field of Search ..... 72/160, 163, 245, 236

[56] References Cited

U.S. PATENT DOCUMENTS

| | | | |
|---|---|---|---|
| 3,245,244 | 4/1966 | Polakowski | 72/163 |
| 3,260,093 | 7/1966 | Polakowski | 72/163 |
| 3,270,543 | 9/1966 | Polakowski | 72/162 |
| 3,344,637 | 10/1967 | Polakowski | 72/64 |
| 3,513,677 | 5/1970 | Polakowski | 72/163 |
| 3,812,697 | 5/1974 | Kawaguchi et al. | 72/60 |
| 3,812,701 | 5/1974 | Miyamatsu et al. | 72/163 |
| 3,828,599 | 8/1974 | Withrow | 72/163 |
| 3,958,439 | 5/1976 | Kawaguchi et al. | 72/163 |
| 4,043,162 | 8/1977 | Noe et al. | 72/163 |

*Primary Examiner*—W. D. Bray

*Attorney, Agent, or Firm*—Biebel, French & Nauman

[57] ABSTRACT

A leveling apparatus for leveling strips of metallic material comprising a support housing; a guide tube, rotatably attached to the support housing, having a hollow interior and a longitudinal slot; a cylindrical support roll, rotatably attached to the housing and positioned within the guide tube; a cylindrical work roll having a diameter substantially less than the support roll and positioned within the slot; and a feedback control for rotating the guide tube to position the work roll such that forces exerted upon the work roll by a metallic strip passing over it act to hold the work roll against the support roll, and tangential components of the force tending to urge the work roll against the guide tube are minimized. In a preferred embodiment, the control comprises a pair of opposing cylinders which are pressurized by a source of compressed fluid. A servo valve responsive to forces exerted by the work roll upon the guide tube depressurizes one of the cylinders and pressurizes the other causing an imbalance in which a rod joining the cylinders is displaced to rotate the guide tube to a position in which the force exerted by the work roll upon the guide tube is minimized.

13 Claims, 8 Drawing Figures

TENSION LEVELING APPARATUS

BACKGROUND OF THE INVENTION

The present invention relates to devices for flexing metal strips and, more particularly, devices for tension leveling metal strips by bending the strips around rolls having a relatively small diameter.

In the manufacture of strip coils of common metals such as alloy steels, aluminum and the like, there exists the problem of producing a strip which is sufficiently flat to be used in end-products such as automobiles and metal furniture. In this context, the term "flat" means that, when unstressed, a section of the metallic strip is substantially planar in shape, with minimum deviations in the form of wavy edges or ripples in interior portions.

Even the most sophisticated rolling mills are unable to produce strip coils in which the strip has been reduced in thickness with sufficient uniformity to lie flat in a plane. For example, should a rolling mill reduce the thickness of a strip a larger amount along its edges than in its interior portion, thereby elongating the edges a greater amount than the interior, the resultant strip will have waves along its edges. Conversely, if the reduction in thickness of a strip is greater in its center, the center is elongated more than the edges, and a strip having a series of bubbles or buckles in its center is formed. In both cases, the deviation from flatness results from a nonuniform elongation in a metal strip caused by a nonuniform reduction in the strip thickness by the rolling mill.

In order to eliminate such defects in strip coils, the coils are processed on tension leveling lines subsequent to rolling. A typical tension leveling line, such as that disclosed in the Withrow U.S. Pat. No. 3,828,599 and the Kawaguchi et al. U.S. Pat. No. 3,958,439, includes an entry drag bridle, an exit tension bridle and flexing means positioned between the entry and exit bridles. The strip is uncoiled by an uncoiling apparatus, passed through the tension leveling line, then recoiled on a recoiler.

The flexing means typically includes a plurality of work rolls having a relatively small diameter about which the strip of material is passed. The rolls are positioned to extend transversely of the strip and are located so that the strip forms an undulating or zig-zag path as it passes from one work roll to the next. The entry drag bridle and exit tension bridle apply a tensile force to the strip as it passes through the flexing means, forcing the strip to conform to the small radiuses of the work rolls. As the strip passes about a work roll, it is deformed to provide a slight elongation of those portions across the width of the strip which are slightly shorter in length and are the cause of the deviation of the strip from the flat condition. Generally, tension leveling systems are capable of elongations of up to 2%, but most defects can be corrected by less than 1.0% elongation.

In order to provide sufficient elongation to eliminate defects in strip coils, early tension leveling systems employed a relatively large number of work rolls-on the order of six or more. It was discovered that, by reducing the diameter of the work rolls, the bending of the strip at each work roll, and its resulting elongation, was increased, thereby reducing the number of work rolls required to effect a given elongation. However, one problem in providing work rolls of a sufficiently small diameter was that the forces exerted by the moving, tensioned strip coil upon the work roll tended to deflect or bow the work roll and reduce its effectiveness.

In order to prevent the deflection of such small diameter work rolls, support rolls having a relatively large diameter were positioned on a side of the work rolls opposite the strip to reinforce the work rolls and prevent them from deflecting. For example, the Polakawski U.S. Pat. No. 3,260,093 shows a tension leveling apparatus in which a large diameter support roll is rotatably mounted on a frame and a work roll is similarly rotatably mounted on the same support frame directly above the support roll. In the Polakowski U.S. Pat. No. 3,513,677, a tension leveling device is shown in which a work roll having a relatively small diameter is cradled between two larger support rolls. The work roll and both support rolls are rotatably attached to a frame.

A problem inherent in the devices of the aforementioned Polakowski patents is that each of the work rolls is supported by two or more heavier and larger rolls. This geometry must satisfy the need to confine the work roll and support the strip tension. Consequently, work rolls cannot be selected with full freedom to meet the needs of the work material.

Another type of tension leveling system is shown in the Miyamatsu et al. U.S. Pat. No. 3,812,701. That patent shows a tension leveling system in which work rolls of a relatively small diameter are supported within a semi-cylindrical recess formed in a support and float on a liquid lubricating medium.

A problem inherent in the Miyamatsu device is that the fluid supporting the work roll must be supplied in high volume and will inevitably collect on the work material, necessitating additional time and equipment to effect subsequent removal of the fluid.

Accordingly, there is a need for a tension leveling system in which work rolls of a relatively small diameter are supported by relatively large diameter support rolls with a minimum of friction. Furthermore, such a device should be relatively simple in construction in order to keep its size and manufacturing costs to a minimum, and should be rugged and capable of withstanding the hostile environment of a steel or rolling mill.

SUMMARY OF THE INVENTION

The present invention is a tension leveling apparatus which includes a work roll having a relatively small diameter which is supported along its length by a single support roll having a relatively large diameter. The support roll is rotatably attached at a fixed position to a support frame and, therefore, its axis of rotation is fixed in position. In contrast, the work roll is not fixed and is positionable relative to the rotational axis of the support roll by a feedback control system.

The feedback control system senses the direction of the forces exerted upon the work roll by a strip passing over it and positions the work roll relative to the strip and the support roll so that the tangential components of these forces are in equilibrium. Consequently, a major portion of the forces exerted upon the work roll by the strip are applied along a radius of the support roll. The work roll is positioned so that the strip holds it against the support roll and does not require bearings to keep it in place. Therefore, the friction of the work roll against the support roll and against other components of the system is minimized.

One advantage of the tension leveling apparatus of the present invention over prior art system is that work rolls of an exceedingly small diameter—on the order of ¼ inches to ¾ inches (6.39 mm to 19.05 mm)—can be supported by a single support roll of a relatively large diameter—on the order of 5" (127 mm)—without the necessity of expensive bearings or additional support rolls of an intermediate diameter to hold the work roll in position and prevent it from deflecting. By providing a tension leveling apparatus which utilizes a work roll having a relatively small diameter, fewer work rolls are required in a tension leveling line to achieve a given amount of strip coil elongation. Furthermore, the use of small work rolls reduces the amount of strip tension required in a leveling line to generate the requisite bending stresses which cause the elongation of the strip.

In a preferred embodiment of the invention, the feedback control system includes a guide tube having a hollow, cylindrical interior that encloses the support roll and end pieces which are rotatably attached to the support roll so that the guide tube may rotate relative to the support roll. The guide tube includes a longitudinal slot which is defined by opposing guide surfaces and is sized to receive the work roll so that the work roll contacts the enclosed support roll and protrudes beyond the outer surface of the guide tube to contact a strip coil passing over it.

A feedback control device is operatively connected to the guide tube so that it senses a tangential component of the force exerted by a strip coil upon the work roll which tends to urge the work roll against one of the guide surfaces of the guide tube. The control device includes a pair of opposing, pressurized cylinders having pistons which are joined by a common rod that is linked to the guide tube. The control system selectively depressurizes one of the cylinders and pressurized the other so that the pistons urge the rod and guide tube to rotate in a direction counter to the tangential force applied against the guide tube by the work roll until that force component is minimized.

One advantage of the control system design of the preferred embodiment is that the guide tube houses the work roll within a slot without the use of expensive anti-friction bearings which would add to the cost of manufacturing the apparatus as well as the cost of maintaining the apparatus.

Accordingly, it is an object of the present invention to provide a tension leveling apparatus in which a work roll having a relatively small diameter is supported by a single support roll having a relatively large diameter; a tension leveling apparatus in which a feedback control system continuously positions the work roll relative to the support roll in order to balance the tangential forces exerted upon the work roll by a strip coil passing over it so that the forces tending to displace the work roll are in equilibrium; a tension leveling apparatus in which the work roll is supported relative to a support roll without expensive and delicate anti-friction bearings; and a tension leveling apparatus which is relatively simple in construction and yet provides a high degree of strip elongation per unit.

Other objects and advantages of the present invention will be apparent from the following description, the accompanying drawings and the appended claims.

DETAILED DESCRIPTION OF THE PREFERRED EMBODIMENTS

Figure 1:
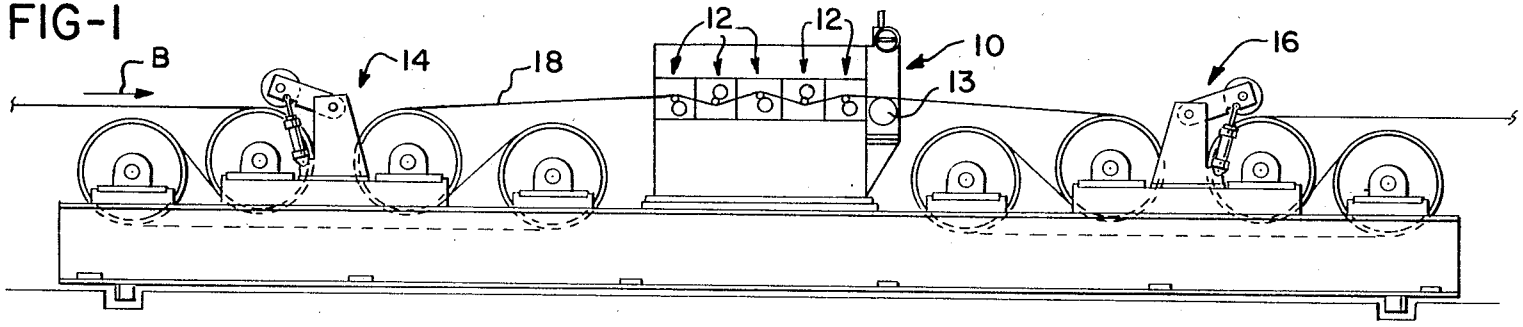
FIG. 1 is a somewhat schematic side elevation of a tension leveling line having a plurality of tension leveling apparatuses of the preferred embodiment of the invention.

As shown in FIG. 1, a preferred embodiment of the tension leveling apparatus, generally designated 10, comprises five tension leveling modules 12. The apparatus also preferably includes a vertically positionable roller 13 which is used to remove any curvature in the strip 18 remaining after passing through the leveling modules 12. The tension leveling apparatus 10 is positioned between an entry drag bridle assembly 14 and an exit tension bridle assembly 16. The entry drag bridle 14 and exit tension bridle 16 are of well-known design and, together with the tension leveling apparatus 10, form a tension leveling line for leveling a strip 18 of metallic material such as steel, aluminum and the like. The strip 18 is unwound from a coil mounted on an uncoiler (not shown) and fed through the bridle 14. The strip 18 leaving the bridle 16 is rewound into a coil on a recoiler (not shown).

Figure 2:
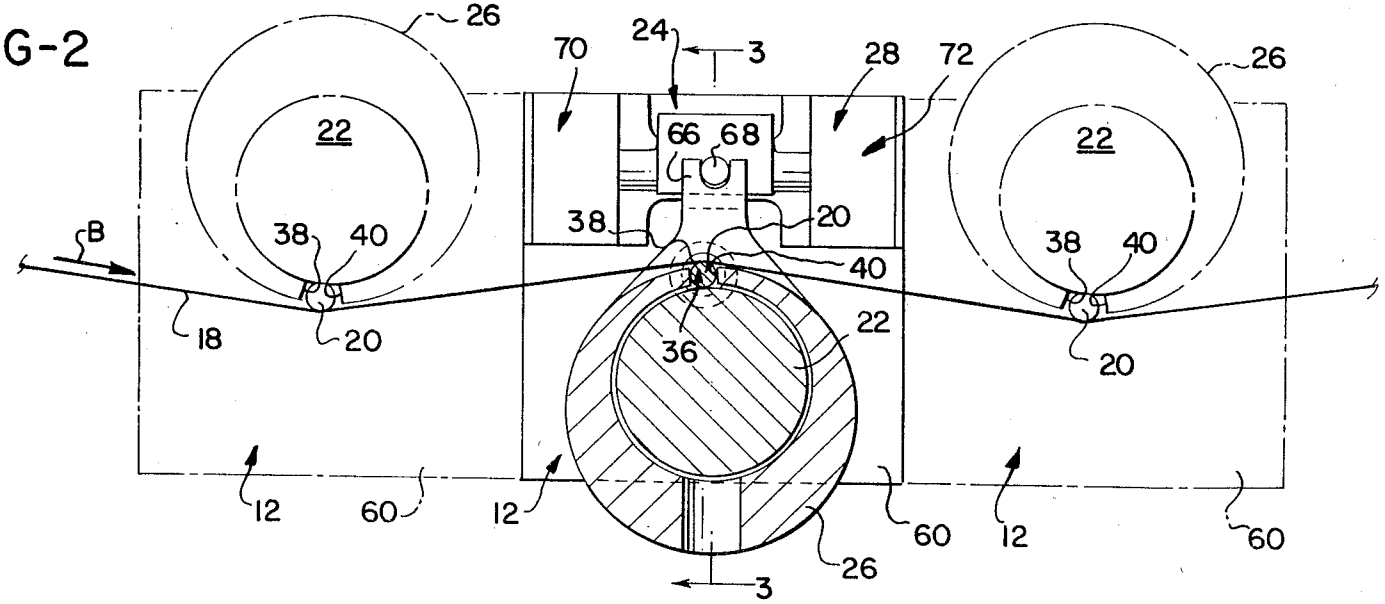
FIG. 2 is a somewhat schematic detail taken from FIG. 1 showing three tension leveling apparatuses.
Figure 3:
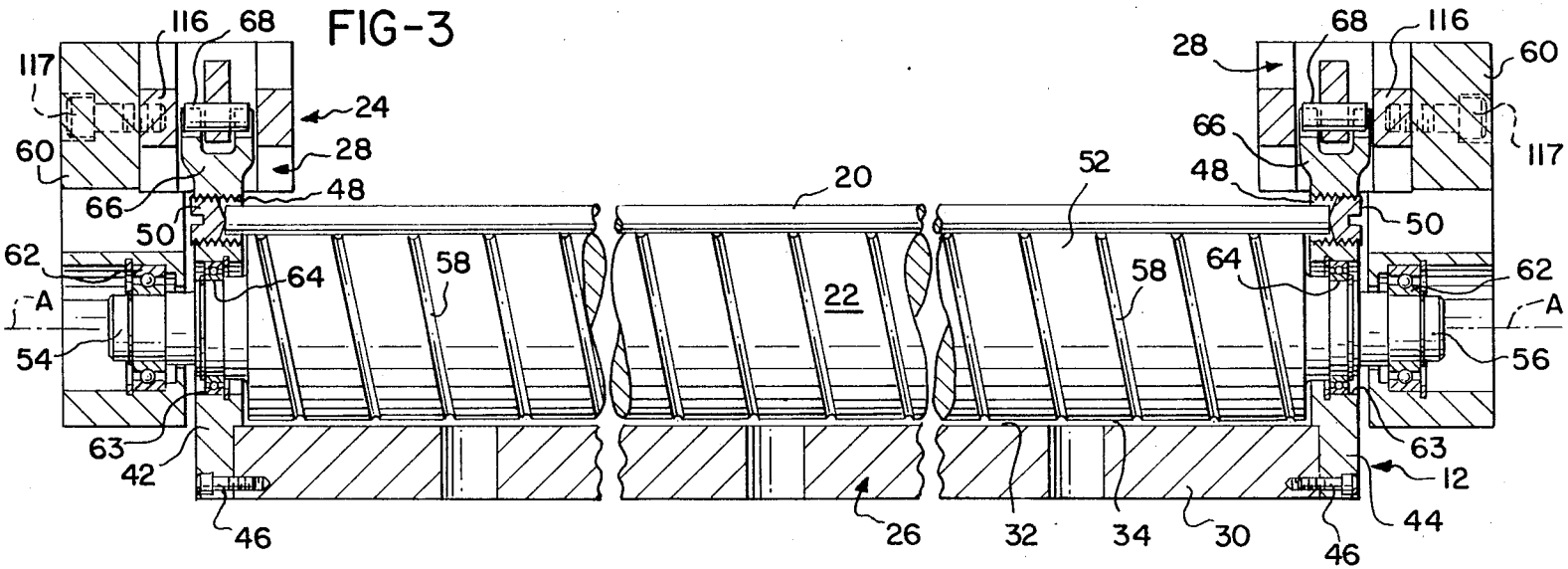
FIG. 3 is a side elevation in section of a tension leveling apparatus taken at 3—3 of FIG. 2, and in which the work roll, support roll and guide tube are partially broken away.

As shown more clearly in FIGS. 2 and 3, each of the tension leveling modules 12 includes a cylindrical work roll 20, preferably having a diameter of between 0.25 inches and 0.75 inches (6.35 mm and 19.05 mm), a cylindrical support roll 22, and a feedback control system 24 which includes a guide tube 26 and controls 28. The modules 12 are arranged in alternating upright and inverted positions so that the strip 18 forms an undulating or zig-zag path as it passes through the tension leveling apparatus 10 and is bent partially around the circumference of each of the work rolls 20.

The guide tube 26 is generally cylindrical in shape and includes a body portion 30 having an interior wall 32 which defines a cylindrical, longitudinal hollow interior 34 sized to receive the support roll 22. The guide tube body 30 includes a longitudinal slot 36 which is bordered by a pair of opposing guide surfaces 38, 40 (see also FIG. 6). The slot 36 is sized to receive the work roll 20, and the body is dimensioned to allow a lower portion of the work roll to contact the support roll 22 and an upper portion of the work roll to protrude outwardly beyond the outer surface of the body to contact a strip 18.

The guide tube 26 includes a pair of opposing end plates 42, 44 which are attached to the ends of the body 30 by bolts 46. The end plates 42, 44 each include an upper opening 48, which is aligned with the slot 36 to permit the work roll 20 to be inserted or removed from the slot. The work roll 20 is captured within the slot 36 and openings 48 by end caps 50 which are threaded into the openings, and preferably are made of a low friction material such as bronze. In the alternative, antifriction bearings may be used.

Figure 7:
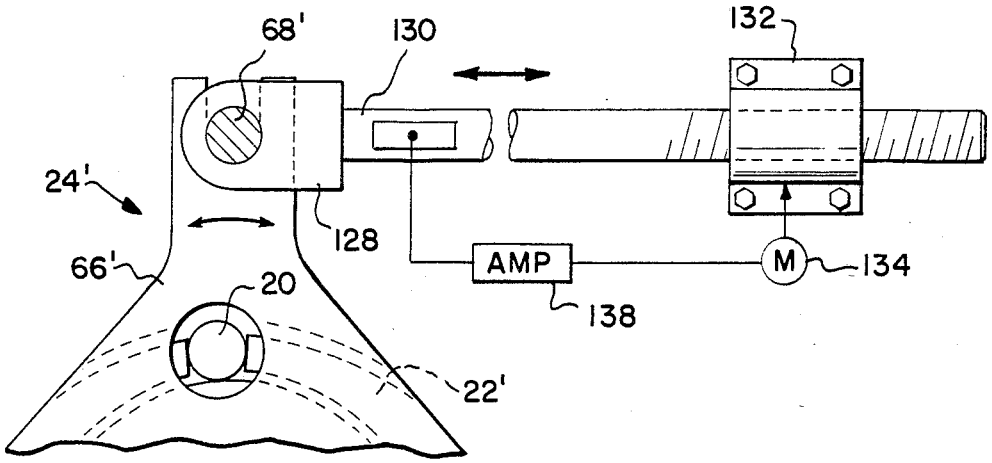
FIG. 7 is a detail side elevation of the feedback control system of an alternate embodiment of the invention.

The support roll 22 consists of a cylindrical main body 52 and a pair of end stubs 54, 56 extending outwardly from the main body along a rotational axis A thereof (see FIG. 7). The main body preferably is made of hardened steel and has a polished outer surface. In the embodiment shown in FIG. 3, the main body 52 also includes a continuous, helical groove 58 which acts to remove accumulations of oxidation picked up from the strip passing over the work roll 20 and circulate lubricating fluid.

The end stubs 54, 56 are rotatably attached to a support frame 60 by anti-friction bearings 62 of well-known design. The end plates 42, 44 of the guide tube 26 each include an opening 63 which includes bearings 64 that support the guide tube on the end stubs 54, 56, so that the guide tube may be rotated independently of the support roll 22.

As shown in FIG. 3, each of the end plates 42, 44 include a yoke portion 66 which pivotally engages a cylindrical pin 68 which is a component of the feedback control system 24. In this preferred embodiment there are two separate controls 28 which comprise the feedback control system 24. However, it is within the scope of the invention to provide a guide tube in which only a single end plate includes a yoke portion which engages a single control.

Figure 4:
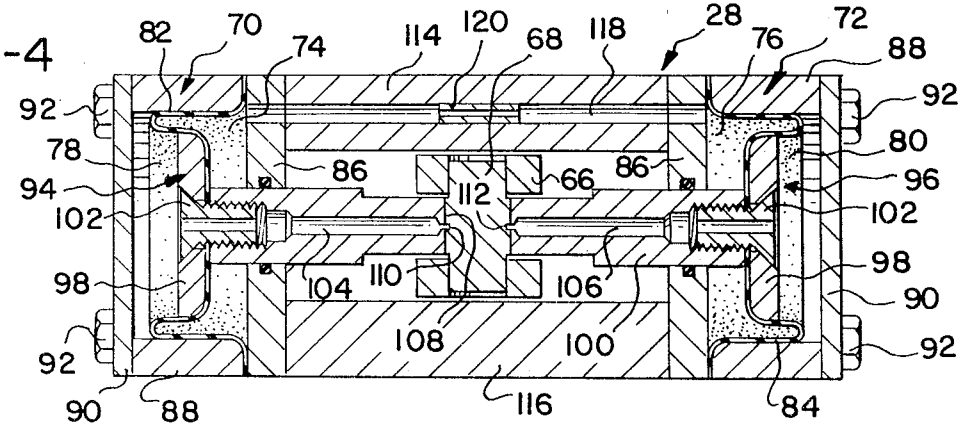
FIG. 4 is a top plan view in section of the feedback control system of the preferred embodiment of the invention, taken at line 4—4 of FIG. 6.
Figure 5:
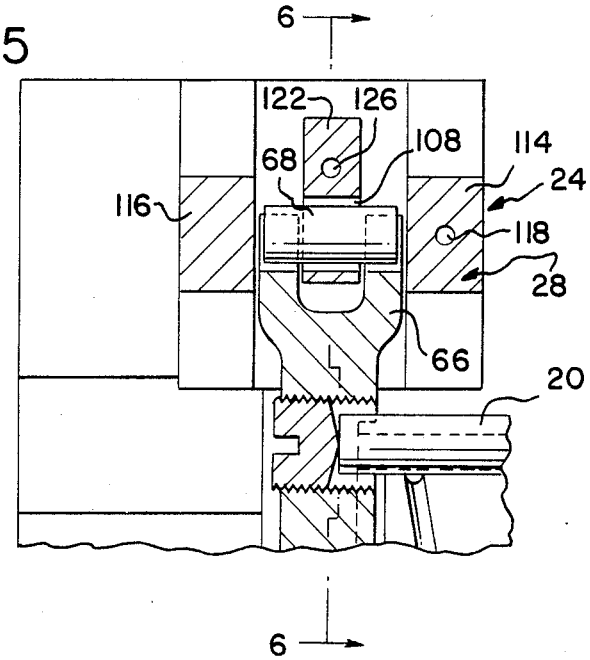
FIG. 5 is a detail of the tension leveling apparatus of FIG. 3 showing the connection between the guide tube and feedback control system.
Figure 6:
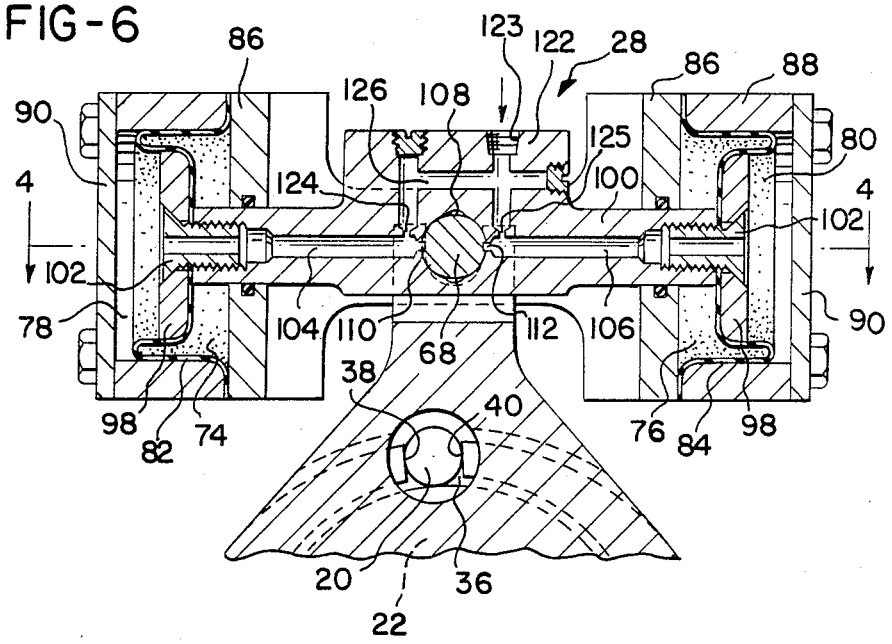
FIG. 6 is a detail side elevation in section of the feedback control system, taken at line 6—6 of FIG. 5.

As best shown in FIGS. 4, 5 and 6, each of the controls 28 include a pair of opposing cylinders 70, 72 which are divided into inner chambers 74, 76 and outer chambers 78, 80 by flexible diaphragms 82, 84, respectively. Each of the cylinders 70, 72 is made up of a base plate 86, an annular side wall 88, and an end plate 90 which is secured to the annular side wall by bolts 92. The outer peripheries of the diaphragms 82, 84 are clamped between the side walls 88 and base plates 86.

Each of the cylinders 70, 72 includes a piston 94, 96, respectively, which comprises a head 98 attached to a rod 100 by a screw 102. The screws 102 pass through central orifices in the diaphragms 82, 84. The heads 98 and rod 100 are shaped to provide a clamping engagement with the diaphragms 82, 84.

As best shown in FIGS. 4 and 6, passages 104, 106 extend between the outer chambers 78, 80 and an outlet opening 108 which surrounds the pin 68. The outlet opening 108 is sized to allow the pin 68 to move slightly within it so that it may alternately block the orifices 110, 112 of the passages 104, 106, respectively. The cylinders 70, 72 are separated by walls 114, 116, which are spaced on either side of the rod 100, pin 68 and yoke portion 66. The side walls 116 of each control 28 are attached to the frame 60 by screws 117 to fix the controls in position (see FIG. 3).

A channel 118 joins inner chamber 74 to inner chamber 76, and extends through the base plates 86 of cylinders 70, 72, and through wall 114. A restriction 120 is placed within the channel 118 to act as a damping means to damp oscillations which might occur during operation of the controls 28.

As shown in FIG. 6, the central portion of the rod 100 includes a manifold 122 having a port 123 which is adapted to be connected to a flexible hose (not shown) connected to a source of pressurized air. The port 123 communicates with a passage 126 which is connected to the passages 104, 106 by orifices 124, 125, respectively, at a point adjacent to the orifices 110, 112. Pressurized air introduced to the port 123 flows through the passage 126 and orifices 124, 125, through passages 104, 106 to pressurize the outer chambers 78, 80 of the cylinders 70, 72.

Pin 68 is a loose fit in the opening 108 allowing air in outer chambers 78, 80 to escape through orifices 110, 112. The orifices 124, 125, 110, 112 are sized such that the pressure of fluid entering port 123 is reduced by approximately 50% through each of the orifices 124, 125, and 50% through each of the orifices 110, 112. In the static condition, outer chamber 78, 80 are at the same pressure, i.e., approximately 50% of the incoming fluid pressure at port 123.

Outer chambers 78, 80 may alternately be depressurized by a slight movement of the pin 68 within the outlet opening 108, which would uncover one or the other of orifices 110, 112, and cover the other, thereby allowing the compressed air within the associated outer chamber to escape to the atmosphere. Concurrently, pressure in the other chamber would rise. The resulting differential would force manifold 122 to act against the initiating movement of pin 68 and move yoke 66, guide tube 26 and guide surfaces 38, 40 to position work roll 20 such that forces acting on it were again in equilibrium.

The operation of the preferred embodiment is as follows. A strip 18 of metal is unwound from a coil on an uncoiler (not shown) and threaded through the entry drag bridle 14, the tension leveling apparatus 10 and the exit tension bridle 16, as shown in FIG. 1. The end of the strip is again formed into a coil on a recoiling machine (not shown) of well-known design. As the strip passes through the tension leveling apparatus 10, proper tension is maintained by the entry drag bridle 14 and exit tension bridle 16, so that the strip is forced to bend partially around the relatively small circumferences of the work rolls 20 of the tension leveling modules 12. This bending causes a slight elongation of the shorter portions of the strip 18 and produces a strip having a substantially uniform length across its width, thereby removing any wavy sections which may have been present in the center of the strip or along its edges.

As the strip 18 travels over the work rolls 20 in the direction of arrows B (see FIGS. 1 and 2), the strip tension and frictional engagement of the strip with the work rolls tends to urge the work rolls to move in the same direction, so that they apply pressure against the guide surfaces 40 of the guide tubes 26. This pressure causes the guide tubes 26 to rotate so that the yoke portions 66 (FIGS. 2–6) apply pressure to the pins 68. This pressure causes the pins 68 to be displaced slightly within the outlet openings 108, thereby closing the orifices 112 and opening the orifices 110.

In each of the modules 12, the controls 28 function in the same fashion. The outer chamber 78, which has been pressurized by compressed air from the manifold 122 in the manner previously described, is depressurized as air escapes through the orifice 110. In contrast, outer chamber 80 remains pressurized since the orifice 112 is closed by the pin 68. This imbalance allows the compressed air in chamber 80 to expand against the piston 98 and displace the pistons 94, 98, rod 100 and pin 68 in a direction toward the depressurized cylinder 70.

As the pin 68 moves with the rod 100, the yoke portion 66 is rotated so that the guide tube 26 rotates in a direction counter to the force applied against guide surface 40. The position of the work roll 20 of each module 12 relative to the strip 18 changes until the pressure of the work rolls against the guide surfaces 38, 40 is substantially eliminated.

Similarly, should the engagement of the strip 18 with the work rolls 20 cause the work rolls to be urged against opposite guide surface 38, the guide tube 26 and yoke 66 will rotate in a counterclockwise direction (as seen in FIG. 2) which applies pressure against the pins 68 to urge them against the orifices 110. This closes the orifices 110 and opens orifices 112 which allows outer chambers 78 to be pressurized while outer chambers 80 become depressurized. The pressurized air expands against the head 98 of the piston 94 to displace the rod 100 and pin 68 is a direction counter to the force exerted by the work roll against the guide surface 38.

Oscillations occurring in the guide tube 26 are damped out by the resistance to fluid flow from the inner chamber 74, 76 through channel 118 and restriction 120.

Thus, the work rolls 20 of the tension leveling modules 12 are maintained in a state of equilibrium so that they are balanced upon and held against their respective support rolls 22 by the strip 18. In this state of equilibrium, the sum of all the forces exerted upon the work rolls 20 by the strip 18 acts along a line which passes through the centers of the work rolls 20 and the support rolls 22, so that the support rolls bear substantially the entire force exerted upon the work rolls, and the guide surfaces 38, 40 of the guide tube 26 bear a minimal amount of force, if any.

Once this state of equilibrium has been achieved for the tension leveling modules 12 of the tension leveling apparatus, it will be necessary during a leveling operation to adjust the position of the work rolls 20 continuously, as unavoidable variations in the speed of the strip or the tension of the strip exerted by the entry and exit bridles 14, 16, respectively, varies. Upon start-up of the tension leveling line, the work rolls 20 may be aligned ramdomly with their respective support rolls 22. But as the strip 18 goes in motion, the feedback control system 24 will displace the work rolls 20 in a direction counter to the direction of strip travel.

Another example of a feedback control system is shown in FIG. 7. The system 24' utilizes a work roll and support roll which are constructed and operate identically to the corresponding components previously discussed and shown in FIGS. 1-5. However, in this embodiment, the yoke portion 66' of the guide tube 22' is shaped to pivotally engage a pin 68' which is attached to a clevis 128. Clevis 128 is attached to a ball bearing screw 130. Screw 130 engages a ball bearing nut 132 which is rotated by reversible servo motor 134, and is attached to a stationary member such as support housing 60 (FIG. 3). The nut must be fixed in position relative to the guide tube 26'.

A strain gauge 136 is mounted on the ball screw 130 and is connected to an amplifier 138. The amplifier 138 includes a comparator which compares the signal generated by the strain gauge 136 with a reference voltage, and generates a positive or negative signal when the screw 130 is placed under tension or compression, respectively. The amplifier is connected to the reversible motor 134.

In operation, linear movement of the strip 18 over the work roll 20 which tends to displace the work roll to the right, as shown in FIG. 7, causes the guide tube to pivot clockwise, placing the ball screw 130 in compression. This compression actuates the strain gauge 136 which activates the motor 134 to displace the screw 130 to the left—a direction counter to the force exerted by the strip 18. When the work roll 20 has reached equilibrium, the stress on the screw 130 felt by the gauge 136 drops to zero, so that the output of the amplifier 138 drops to zero and the motor 134 stops.

If the force exerted by the strip 18 against the work roll 20 urges the work roll to the left, which causes the guide tube 26 to pivot counterclockwise, the screw 130 is placed under tension. This causes the strain gauge 136 to signal the amplifier 138 to activate the motor 134, which displaces the screw 130 to the right until the work roll reaches an equilibrium condition with the strip 18, at which time the force exerted on the screw 130 and strain gauge are zero and the motor 134 again stops. To ensure a smooth response, electric damping may be introduced into this system by well-known means (not shown).

It should be noted that other types of feedback controls may be employed to position the guide tube 26 of the invention. For example, transducers could be used to sense the forces applied by the work roll 20 upon the guide surfaces 38, 40, and a control could be used to activate a double-acting cylinder or reversible motor to pivot the guide tube 26.

Figure 8:
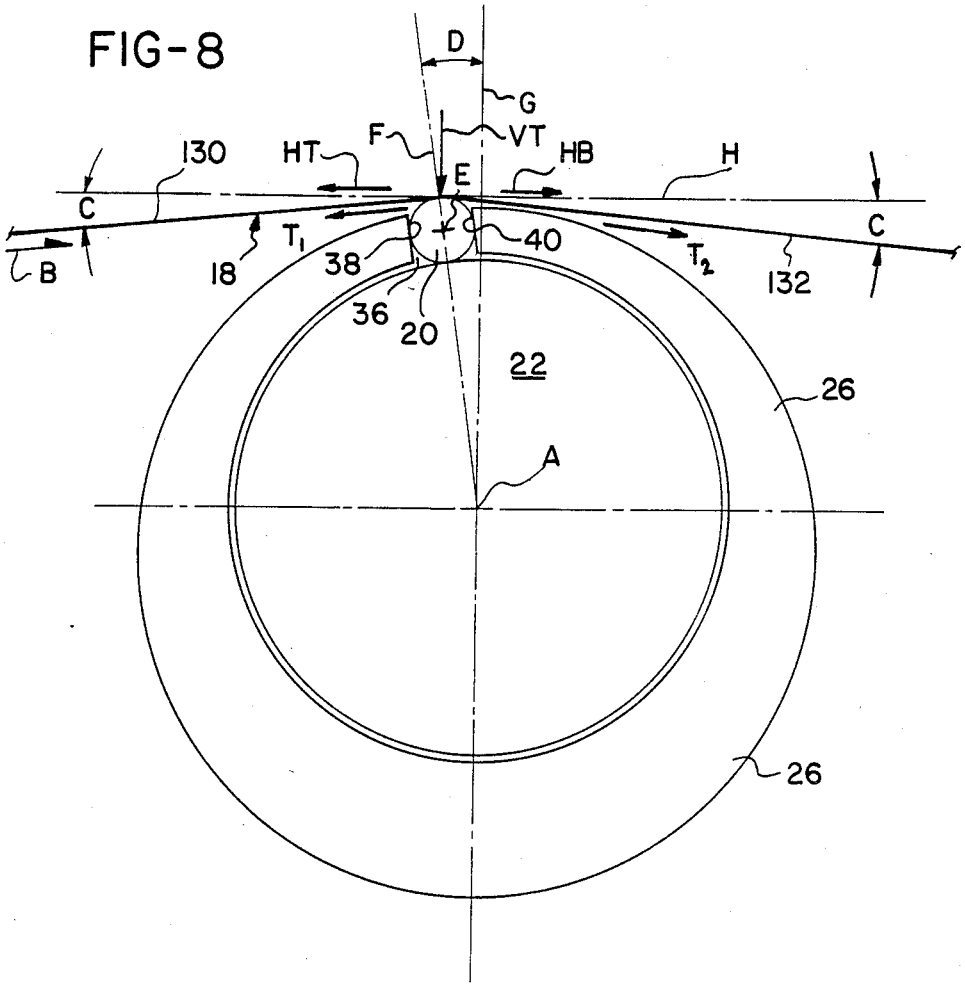
FIG. 8 is a schematic side elevation in section of the work roll, support roll and guide tube of the preferred embodiments of the invention.

An analysis of the forces exerted by a strip 18 upon the work roll 20 and support roll 22 is best shown in FIG. 8. Briefly, the guide tube 26 is rotated by the feedback control system 24 in the manner previously described so that the work roll 20 is positioned relative to the support roll 22 and strip 18 such that the forces of the strip tangential to the work roll are balanced by the tangential component of the vertical forces upon the work roll resulting from strip tension.

During operation of the tension leveling line, the portion 130 of the strip 18 approaching the work roll is under tensile force $T_1$. Bending losses of the strip 18 at the work roll 20 increase the tensile force acting on the portion 132 of the strip leaving the work roll to an amount $T_2$, where:

$$T_2 = T_1 + (\text{Bending Losses})$$

A component HB of the tensile force $T_2$ of the strip 18 parallel to the straight path of the strip (represented by line H) acts on the roll, where:

$$HB = (\text{Bending Losses}) \times \text{Cos } C$$

Angle C is the angle at which the strip 18 bends from a straight path.

A force VT, normal to the straight path of the strip, is exerted upon the work roll 20 by the strip 18 and is represented by the following equation:

$$VT = (T_1 + T_2) \times \text{Sin } C$$

Since the work roll is offset toward the entry side of the backup roll 22, a component HT of VT, which is the component of VT acting parallel and opposite to HB, acts upon the work roll 20 in a direction opposite to the Bending Losses and is calculated by the following equation:

$$HT = (T_1 + T_2) \times \text{Sin } C \times \text{Tan } D$$

Angle D is the angle at which a line F, which passes through the center E of the work roll 20 and the center A of the support roll 22 makes with a line G which passes through the center A of the support roll and is perpendicular to the straight path of the strip, represented by line H.

If the value of angle D is chosen such that HB=HT, forces tangential to the work roll 20 are reduced to a very low value, thereby minimizing friction between the work roll and the guide surfaces 38, 40 of the guide tube 26. In addition, the resultant of the forces acting upon the work roll 20 acts to hold the work roll against the support roll 22. It should be noted that for the purposes of this discussion the angle made by the strip with the straight path represented by line H before the work roll 20 equals the angle made by the strip with line H after passing over the roll.

The action of the feedback control systems described earlier will ensure that angle D is automatically and continuously maintained at the value which results in equilibrium of work roll 20. Any change in tension, roll loss or strip velocity which upset this equilibrium will result in movement of work roll 20 towards one or the other guide surfaces 38 or 40 and produce a displacement of pin 68 to produce a response in the feedback control system to force the work roll 20 to a new position of equilibrium.

While the forms of apparatuses herein described constitute preferred embodiments of the invention, it is to be understood that the invention is not limited to these precise forms of apparatuses, and that changes may be made therein without departing from the scope of the invention.

What is claimed is:

1. A tension leveling apparatus for leveling strips of metallic material, comprising:

support means;

a support roll rotatably attached to said support means;

a work roll positioned on said support roll;

guide means having a pair of opposing guide surfaces receiving said work roll therebetween, said guide surfaces being movable relative to said support roll such that said surfaces are positionable about a periphery of said support roll; and control means for moving said guide surfaces to position said work roll relative to said support roll such that forces exerted upon said work roll by a metallic strip passing thereover act to hold said work roll against said support roll, and components of said forces tangential to said work roll are in equilibrium.

2. A tension leveling apparatus for leveling strips of metallic material, comprising:

a support housing;

guide means rotatably attached to said housing and having a hollow interior and opposing guide surfaces forming a longitudinal slot therethrough;

a cylindrical support roll positioned within said hollow interior and attached to said housing to rotate about a central, rotational axis of said support roll;

a cylindrical work roll having a diameter substantially less than said support roll and positioned within said slot such that one portion thereof contacts and is supported by said work roll and a different portion thereof protrudes outwardly from said guide tube sufficiently to engage a metallic strip passing thereover; and means for rotating said guide means to position said slot and work roll such that forces exerted upon said work roll by a metallic strip passing thereover act to hold said work roll against said support roll, and components of said forces tangential to said work roll are in equilibrium.

3. The leveling apparatus of claim 2 wherein said rotating means comprises feedback servo means for sensing said tangential force components urging said work roll against said guide surfaces, and rotating said guide means to restore said equilibrium.

4. The leveling apparatus of claim 3 wherein said servo means comprises a pair of opposing cylinders; a pair of pistons, each positioned within one of said cylinders; rod means joining said cylinders together; means for supplying fluid under pressure to said cylinders; means connecting said rod means to said guide means such that said tangential forces producing movement of said guide tube relative to said cylinders causes differential changes in fluid pressure in said cylinders so that said pistons in said cylinders are displaced in a direction counter to said tangential component, thereby displacing said rod means and said guide means to restore said equilibrium.

5. The leveling apparatus of claim 4 wherein said pistons separate each of said cylinders into inner and outer chambers; said rod means includes a passage joining said outer chambers; said valve means includes an opening formed in said rod means, dividing said passage into two segments, each associated with one of said cylinders, and open to the atmosphere, and further includes pin means positioned within said opening and displaceable therein to a guide means actuating position such that one of said segments is closed to the atmosphere, thereby causing an associated one of said outer chambers to be pressurized, and the other of said segments is opened to the atmosphere; thereby causing an associated one of said outer chambers to be depressurized, thereby forcing said guide means into a stabilizing position such that both of said segments are open to the atmosphere and both of said outer chambers are equally pressurized.

6. The leveling apparatus of claim 5 wherein said guide means includes yoke means pivotally attached to said pin means.

7. The leveling apparatus of claim 6 wherein said support roll includes a pair of stubs extending outwardly from ends thereof and rotatably attached to said housing; and said guide means is rotatably attached at ends thereof to said stubs.

8. The leveling apparatus of claim 7 wherein said guide means includes a substantially cylindrically-shaped body having said slot and hollow interior; and a pair of end plates attached at ends of said body and including said yoke means.

9. The leveling apparatus of claim 8 wherein said servo means further comprises means for damping displacement of said pistons relative to said cylinders and thereby reduce instability of said servo means.

10. The leveling apparatus of claim 9 wherein said damping means includes a channel joining said inner chambers of said cylinders together; means forming a restriction within said channel; and a fluid within said channel for flowing from one of said inner chambers to the other of said chambers in response to movement of said cylinders.

11. The leveling apparatus of claim 3 wherein said feedback servo means comprises screw means pivotally attached to said guide means; nut means threaded on said screw means and fixed relative to said guide means;

means for rotating said nut relative to said screw means in forward and reverse directions; and means responsive to application of a tensile or a compressive force on said screw means by rotation of said guide means for actuating said rotating means to rotate said nut means such that said screw means is displaced thereby in a direction counter to application of said tensile or compressive force, whereby said guide means and said work roll are rotated such that said tangential force components are in equilibrium.

12. The leveling apparatus of claim 11 wherein said responsive means comprises a strain gauge attached to said screw means; and amplifier means connected to said strain gauge means for receiving a signal therefrom and connected to said rotating means, for generating a signal to activate said rotating means.

13. A tension leveling apparatus for leveling strips of metallic material, comprising:

a support housing;

a cylindrical support roll having a pair of stubs extending from ends thereof, said stubs rotatably attached to said support housing such that said support roll rotates about a central, rotational axis of said support roll;

a guide tube having a substantially cylindrically-shaped body including a cylindrically-shaped inner wall forming a hollow interior sized to receive said support roll therein, said body having opposing guide surfaces forming a longitudinal slot therethrough, and a pair of end plates attached at ends of said body and rotatably attached to said support roll, said end plates including upwardly extending yoke means;

a cylindrical work roll having a diameter substantially less than said support roll and positioned within said slot such that one portion thereof contacts said work roll and a different portion thereof protrudes outwardly from said guide tube sufficiently to engage a metallic strip passing thereover; and means connected to said yoke means and responsive to pressure exerted by said work roll against said guide tube for rotating said guide tube to position said work roll such that a force exerted upon said work roll by a metallic strip passing thereover acts to hold said work roll against said support roll, and components of said force tangential to said work roll tending to urge said work roll against said guide surfaces are in equilibrium.

* * * * *